United States Patent [19]

Hanger

[11] Patent Number: 4,493,170

[45] Date of Patent: Jan. 15, 1985

[54] ABRADING TOOL

[75] Inventor: Randolph T. Hanger, Seattle, Wash.

[73] Assignee: The Boeing Company, Seattle, Wash.

[21] Appl. No.: 323,017

[22] Filed: Nov. 19, 1981

[51] Int. Cl.[3] ..... B24D 9/08

[52] U.S. Cl. ..... 51/330; 51/382

[58] Field of Search ..... 51/358, 394, 332, 400, 51/334–336, 401, 354, 364, 330, 382, 177, 174, 337; 15/179, 180, 181, 182, 183, 230.16

[56] References Cited

U.S. PATENT DOCUMENTS

| | | | |
|---|---|---|---|
| 547,827 | 10/1895 | Webster . | |
| 573,735 | 12/1896 | Webster . | |
| 1,869,564 | 8/1932 | Johnston . | |
| 1,882,769 | 10/1932 | Bugg | 51/334 |
| 2,480,739 | 8/1949 | Johnson | 51/177 |
| 2,535,637 | 12/1950 | Johnson | 51/334 |
| 2,549,043 | 4/1951 | Arthur | 51/334 |
| 2,597,421 | 5/1952 | White | 51/334 |
| 2,608,034 | 8/1952 | Fromson . | |
| 2,668,976 | 2/1954 | Beach | 51/334 |
| 2,720,064 | 10/1955 | Klug | 51/334 |
| 2,753,576 | 7/1956 | Libecap | 15/183 |
| 2,767,526 | 10/1956 | Moran | 51/335 |
| 2,819,567 | 1/1958 | Hall . | |
| 3,228,053 | 1/1966 | Horton et al. | 15/183 |
| 3,357,141 | 12/1967 | Annis, Jr. . | |
| 3,605,347 | 9/1971 | Barry | 51/330 |
| 3,616,581 | 11/1971 | Johnson et al. . | |
| 3,645,049 | 2/1972 | Freerks et al. | 51/334 |
| 3,678,529 | 7/1972 | Woods et al. | 15/180 |
| 3,696,563 | 10/1972 | Rands . | |
| 3,747,285 | 7/1973 | Block . | |
| 3,790,983 | 2/1974 | Whitsett . | |
| 3,858,367 | 1/1975 | Whitsett . | |
| 3,913,282 | 10/1975 | Whitsett . | |
| 4,037,369 | 7/1977 | Campbell | 15/180 |

FOREIGN PATENT DOCUMENTS

| | | | |
|---|---|---|---|
| 2411749 | 9/1975 | Fed. Rep. of Germany | 51/334 |
| 1538656 | 9/1968 | France | 15/180 |
| 0368980 | 10/1939 | Italy . | |
| 0708183 | 4/1954 | United Kingdom | 15/180 |

*Primary Examiner*—Frederick R. Schmidt
*Assistant Examiner*—Robert A. Rose
*Attorney, Agent, or Firm*—William C. Anderson

[57] ABSTRACT

An abrading tool for finishing surfaces comprising, in one embodiment (5), one or more sanding fingers (20) keyed to a rotatable disc (15). A biasing spring (65), disposed proximate each sanding finger (20), tends to force the sanding fingers (20) towards the surface to be finished by biasing the sanding fingers (20) towards a position which is vertical or substantially perpendicular to the disc (15).

1 Claim, 18 Drawing Figures

Fig. 5.
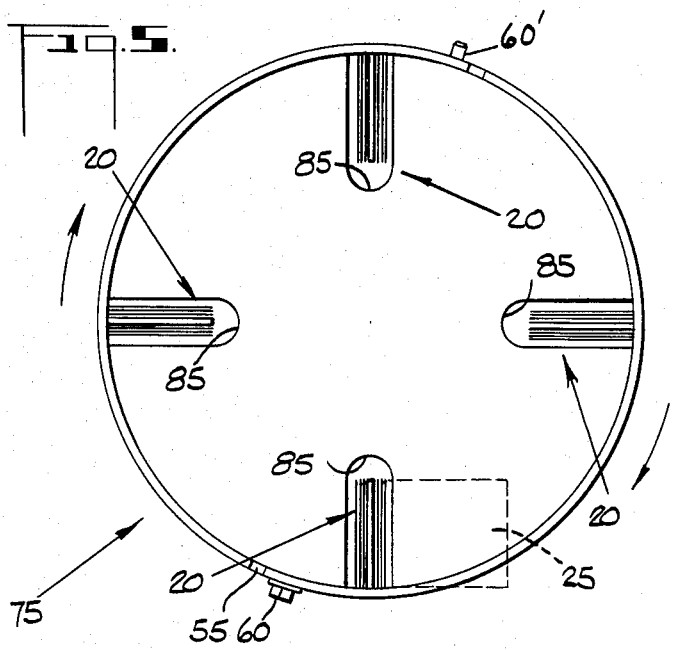
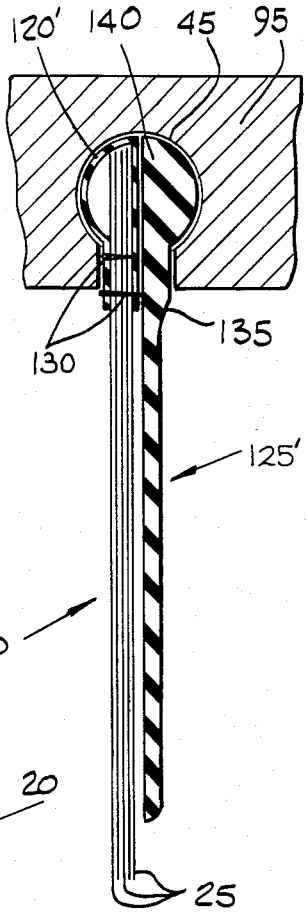
Fig. 11.
Fig. 4.
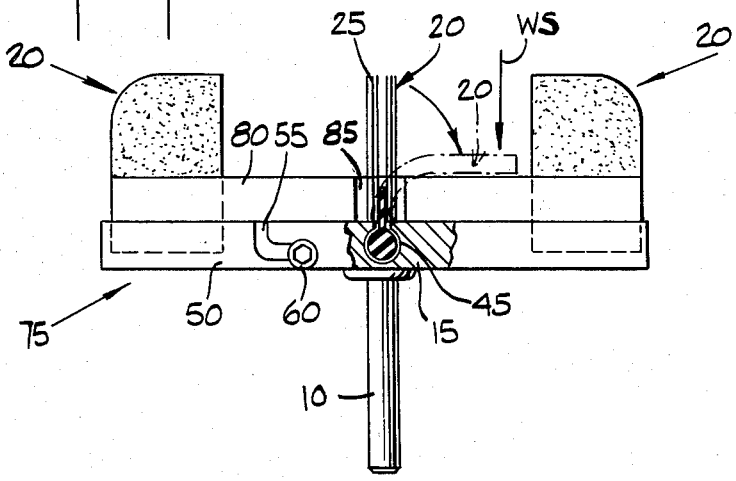

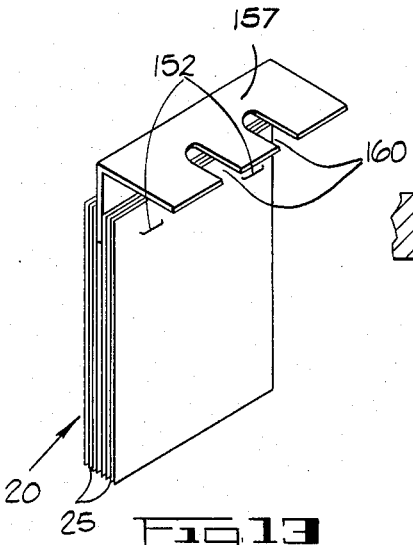
FIG. 13
FIG. 12
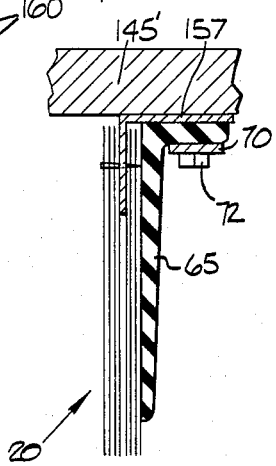
FIG. 14
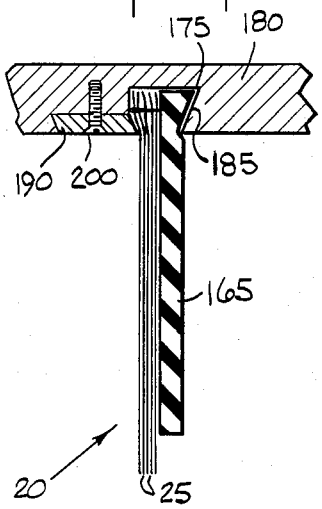
FIG. 16
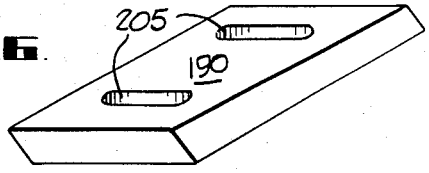
FIG. 15
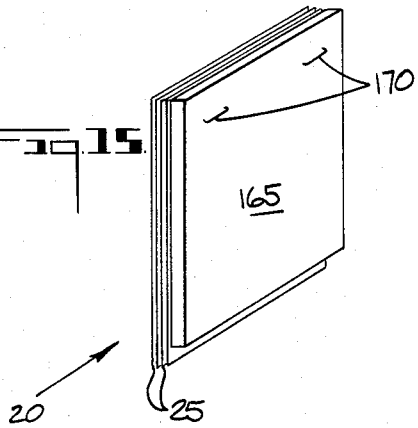

ABRADING TOOL

TECHNICAL FIELD

This invention relates to surface finishing apparatus and more particularly relates to a rotary abrading tool having sanding members biased towards the surface to be finished.

BACKGROUND OF THE INVENTION

Surface abrading apparatus or tools are exemplified by the use of one or more abrasive sanding members that are suitably mounted on a movable member. These apparatus have found great use in the abrading or finishing of surfaces, such as, for example, the surfaces of relatively roughly formed metal parts, etc. In use, the sanding members are forcibly applied to and moved across the surface to be finished or the work surface, whereby a smooth finish may be obtained.

However, prior attempts at finishing surfaces through abrasion do not facilitate the maintenance of a uniform sanding pressure on the work surface whereby the sanding members are all kept in continuous contact with the work surface. Furthermore, the prior art has not provided an abrading tool which aids in the control of the sanding pressure. Also, the prior art has failed to produce an abrading tool which increases the likelihood that all the sanding members simultaneously contact the work surface. A simultaneous contact will generate a multi-directional finish on the work surface minimizing the probability of creating undesirable uni-directional striations. Finally, the prior art has not utilized an abrading tool which ensures that all the sanding members have a maximum contact with the work surface thereby decreasing the time necessary to obtain a smooth finish on the work surface.

SUMMARY OF THE INVENTION

The present invention overcomes these disadvantages of the prior art through the use of an abrading tool having a rotatable support carrying at least one abrasive member. Finally, a means for biasing said abrasive member towards a position which is substantially perpendicular to said support is provided.

The present invention also provides an abrader for mounting on a rotatable body comprising at least one abrasive means. A flexible biasing means configured for mounting on the rotatable body is provided. The biasing means is capable of biasing the abrasive means towards a position that is substantially perpendicular to the rotatable body.

The instant invention also relates to an abrading tool having a rotatable support and an elongated abrasive element. A flexible biasing means is configured for mounting on the rotatable support. The biasing means is capable of biasing the abrasive element towards a position that is substantially perpendicular to the rotatable support.

This invention further relates to abrading apparatus mountable on a rotatable body comprising at least one abrasive member and means associated with the abrasive member capable of being mounted or the rotatable body. Means for biasing the abrasive towards a position which is substantially perpendicular to the rotatable body are provided. Associated with the biasing means is a means capable of being mounted on the rotatable body.

Also provided with the instant invention is a tool for use in abrading a work surface comprising a rotatable hub. At least one elongated abrasive element cooperates with a means for mounting the abrasive member on the hub. A biasing means tending to force the abrasive element towards a position which is substantially perpendicular to the hub is provided and cooperates with a means for mounting the biasing means on the hub.

The present invention additionally provides an abrasive member mountable upon a rotatable support. The abrasive member comprises a first plate adapted to be mounted upon the support and a second plate attached to the first plate substantially perpendicular to the first plate. A plurality of flexible abrasive leaves are fastened to the second plate.

This invention also provides an abrasive unit mountable within a recess formed within a rotatable member comprising at least one sheet of abrasive material. The abrasive material is received within an axial channel formed in a rotatable elongated clamp adapted to be inserted within the recess.

Finally, the present invention relates to a clamp adapted to attach an abrasive member to a rotatable hub wherein the clamp comprises a rotatable cylindrical body. The body is provided with an axial slot adapted to retain the abrasive member. A means formed on the periphery of the body, adapted to allow rotation of the body within the hub, is also provided.

BRIEF DESCRIPTION OF THE DRAWINGS

The present invention will be more apparent from the following specification and drawings wherein:

FIG. 4 is a side view, with parts broken away, of a second embodiment of an abrading tool of the present invention.

FIG. 5 is a plan view of the abrading tool of FIG. 4.

FIG. 11 is a cross-sectional view of another alternate embodiment for mounting an abrasive member and a flexible biasing spring.

FIG. 12 is a cross-sectional view of still another embodiment for mounting an abrasive member.

FIG. 13 is a perspective view of the abrasive member of FIG. 12.

FIG. 14 is a cross-sectional view of yet another embodiment for mounting an abrasive member and a flexible biasing spring.

FIG. 15 is a perspective view of the abrasive member and the biasing spring of FIG. 14.

FIG. 16 is an enlarged view of a portion of the mounting for the abrasive member and biasing spring of FIG. 14.

DETAILED DESCRIPTION OF THE INVENTION

Figure 2:
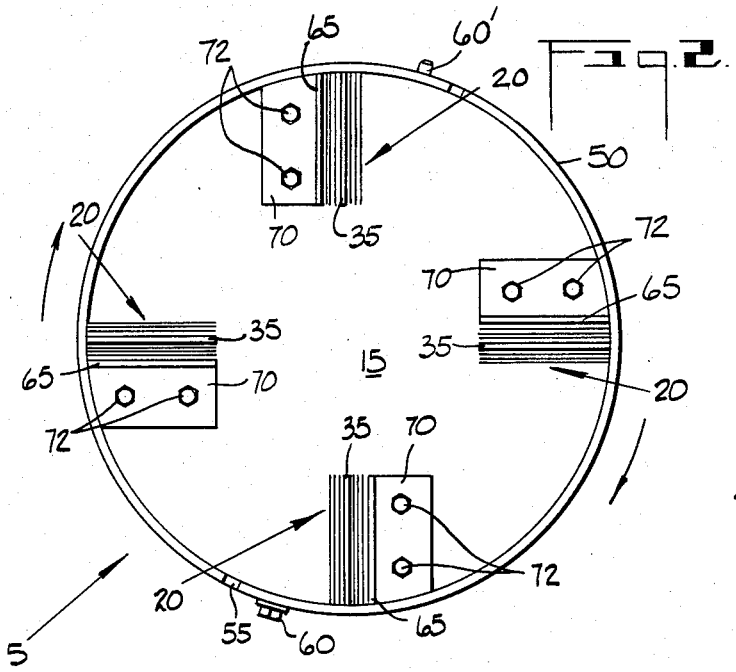
FIG. 2 is a plan view of the abrading tool of FIG. 1.
Figure 3:
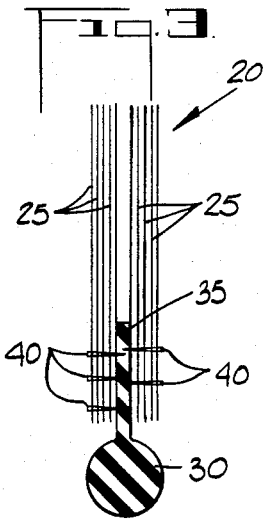
FIG. 3 is a cross-sectional view of an elongated abrasive member useful in the present invention.
Figure 1:
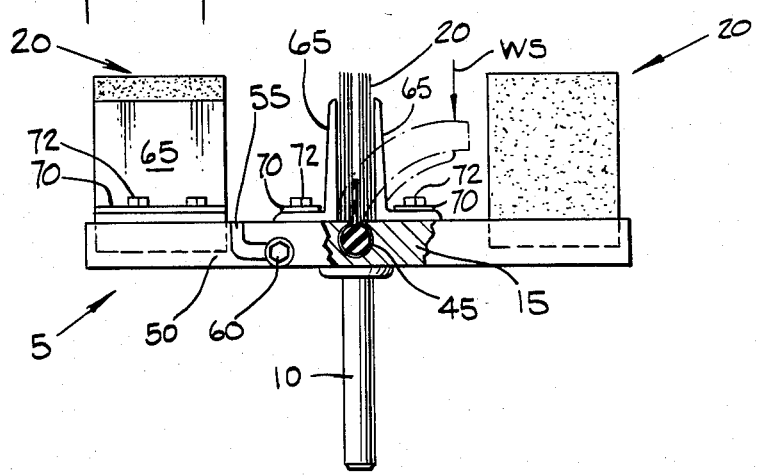
FIG. 1 is a side view, with parts broken away, of a first embodiment of an abrading tool of the present invention.

Referring now to the drawings wherein like reference characters designate the same or similar parts throughout the several views and in particular to FIG. 1 which illustrates a sander assembly or an abrading tool 5 comprising a shaft 10 rotatable by an appropriate means such as a motor (not shown). The shaft 10 is suitably connected to a rotatable hub structure or a disc 15 forming a mounting surface or a support for one or more elongated abrasive members or sanding fingers 20. The abrasive members 20, illustrated in FIG. 3, are of generally conventional construction and are described in greater detail in U.S. Pat. No. 3,747,285, incorporated herein by reference.

As is shown in FIG. 3, each sanding finger 20 comprises a plurality of flexible abrasive leaves or sheets of sandpaper 25. Optionally, tines, chains or stiff brush abraders (not shown) may be substituted for the sandpaper sheets. A flexible key 30, having a stem 35, is juxtaposed in the center of the plurality of sheets 25 and is attached thereto by suitable fasteners such as staples 40. The key 30 is configured to be carried or insertable within a recess or a keyway 45 formed within the disc 15. The keyway 45 and all keyways referred to hereinafter, may be described as having a keyhole cross-sectional configuration in that a peripheral opening or entrance which is narrower in width than the maximum width dimensions of the keyway is provided (see, e.g., FIGS. 1, 4, 8 and 17).

A releasable constraining ring 50 circumscribes the rotatable disc 15 and provides a means for constraining the key 30 of each sanding finger 20 within its associated keyway 45 as the disc is rotated in use. The ring 50 is fastenable upon the disc 15 by means of a slot or a detent 55, formed on the ring 50, which cooperates in a known manner with a lockable bolt 60 threadingly engaging the disc 15. A pin 60′ lockably engages another detent 55′ (not shown in detail) opposite the detent 55. After inserting each key 30 in its associated keyway 45, the ring 50 is locked in place about the disc 15 by means of the locking bolt 60 and the pin 60′.

An elongated, L-shaped flexible spring 65, of elastomeric or metallic material, is carried by or fastened to the upper surface of the disc 15, proximate each of the sanding fingers 20, by any suitable means such as, for example, a clamping plate 70 and bolts 72. The spring 65 tends to bias or force the sanding finger 20 towards a substantially vertical position shown in FIG. 1, a position which is substantially perpendicular to the disc 15, for a purpose better understood hereinafter. As can be seen from the figures, a biasing spring of the present invention is shorter in length than a sanding finger 20 to not interfere with the sanding process.

During sanding of a work surface, represented by the arrow WS, each of the sanding fingers will tend to be forced into a flexed or a horizontal position (shown in phantom) by the work surface. However, the biasing spring 65 will maintain a constant spring force upon the sanding finger 20 which, if unresisted by the working surface, will tend to spring the sanding fingers into the vertical position shown in FIG. 1. As a result, the spring 65 biases the sanding finger against the work surface.

Another abrading tool 75 of the present invention is shown in FIG. 4 and differs from the embodiment shown in FIG. 1 through the use of a biasing compressible pad 80 mounted on or carried by the disc 15. The compressible pad 80 may be made of any suitable elastomeric material and is provided with a slot 85 allowing a sanding finger 20 to pass therethrough. As shown in FIG. 5, each slot 85 is contiguous to each sanding finger 20 but optionally may touch its associated sanding finger 20 to provide a quicker reacting biasing force. Another option (not shown) is to provide each sanding finger 20 with its own discrete compressible pad. With this last option a compressible pad would be placed adjacent a sanding finger 20 in order to aid the sanding finger in resisting any forces imposed on the finger by a work surface.

During use, each sanding finger is flexed as shown in phantom in FIG. 4 and pushed towards the rotatable disc 15 by the working surface (WS). However, the compressible pad 80 tends to resist the flexure of each sanding finger 20 by biasing each finger 20 towards a substantially vertical or perpendicular position (shown in solid in FIG. 4), i.e., towards the working surface.

As can be seen in FIG. 4, the outer portion of each sanding finger 20 has been rounded thereby facilitating the sanding of contoured surfaces or surfaces with small radii. However, the shape of each sanding finger 20 may be ascertained by criteria arising due to need and choice.

Figure 6:
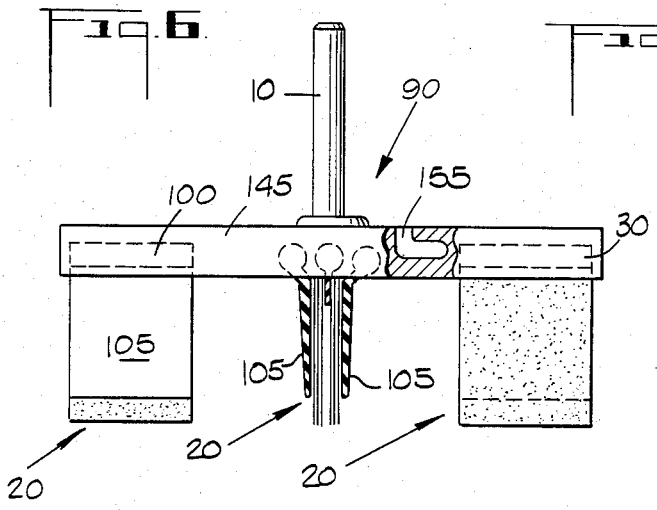
FIG. 6 is a side view, with parts broken away, of a third and preferred embodiment of an abrading tool of the present invention.
Figure 8:
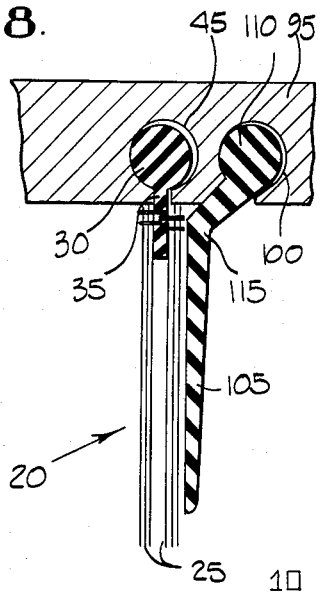
FIG. 8 is a cross-sectional view taken along line 8—8 in FIG. 7.
Figure 7:
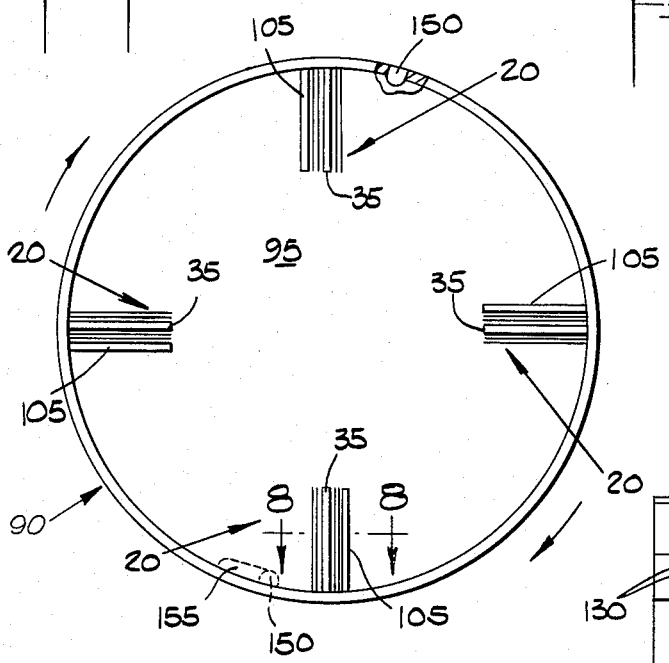
FIG. 7 is a plan view of the abrading tool of FIG. 6.

Referring now to FIG. 6, a preferred embodiment of an abrading tool or a sander of the present invention is designated as 90 and comprises a plurality of abrasive members or sanding fingers 20 carried by or mounted upon a rotatable disc 95. As is illustrated in FIG. 8, a sanding finger 20 comprises sheets of sandpaper 25. The sheets are stapled to a flexible key 30 configured to be insertable within a keyway 45.

Another keyway 100, formed within the disc 95, provides a mounting means for an elongated, flexible biasing spring 105 made of an elastomeric or metallic material and has an integral key 110 adapted to be insertable within the keyway 100. As shown in FIG. 8, the biasing spring 105 has a dog-leg stem 115 allowing the spring to be positioned contiguous the sanding finger 20.

In use, the sander 90 is pressed against a work surface to be finished thereby flexing the fingers 20. The spring 105 will tend to resist this flexure whereby the full benefits of the present invention may be obtained.

Figure 9:
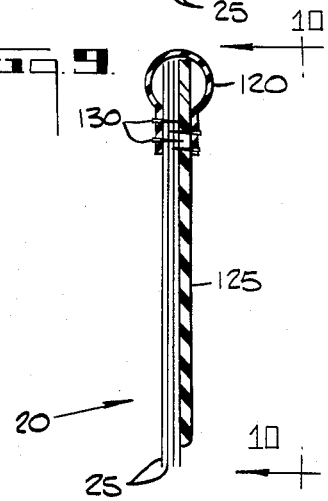
FIG. 9 is a cross-sectional view of an alternative embodiment for mounting an abrasive member and its associated flexible biasing spring.
Figure 10:
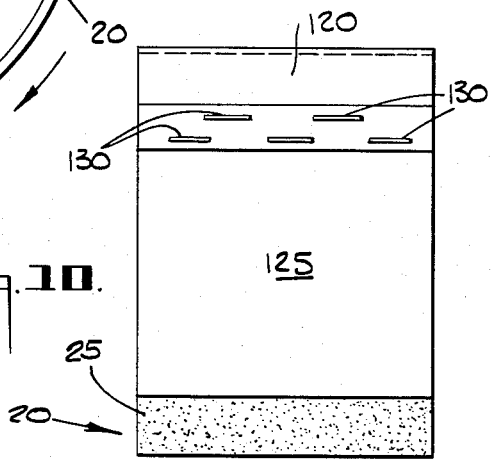
FIG. 10 is a plan view of the embodiment of FIG. 9.

FIGS. 9 and 10 illustrate another method of mounting a sanding finger and a biasing spring on a rotatable disc. In particular, FIG. 9 shows a sanding finger 20 configured to be positioned within a clip 120 of substantially circular cross section and constructed of any desired material such as metal or plastic. A substantially flat, elongated, flexible biasing spring 125 of suitable material is disposed proximate the sanding finger 20 and is clamped within the clip 120. A plurality of fasteners, such as, e.g., staples 130, fix the sanding finger 20 and the spring 125 within the clip 120 which is configured to insertable within a suitable keyway formed within a rotatable disc.

Referring now to FIG. 11, still another embodiment of a means for mounting a sanding finger and a flexible biasing spring within a rotatable disc is illustrated. The sanding finger 20 is fixedly clamped, using a plurality of staples 130, within a substantially semi-circular clip 120' fabricated out of any suitable material such as metal or plastic. A flexible biasing spring 125' is disposable adjacent the sanding finger 20 and is provided with a transition section 135 leading to a substantially semi-circular key section 140. Both the clip 120' acting as a key and the key section 140 of the spring 125' are configured to be insertable within a keyway, such as the keyway 45.

During use, the sanding fingers and the flexible biasing springs in each of the embodiments illustrated in FIGS. 8, 9 and 11 are constrained within their associated keyways within the rotatable disc 95 by means of a releasable constraining ring 145 circumscribing the disc 95. The ring 145 is attachable to the disc 95 by means of protrusions 150. The protrusions are formed on the inner surface of the ring 145 and are engagable with slots or detents 155 that receive and lock the protrusions in a known manner.

The releasable constraining ring is eliminated in the embodiments illustrated in FIGS. 12–18. For example, in FIG. 12, a sanding finger 20 and a flexible biasing spring 65 are shown mounted upon a rotatable disc 145'. The sanding finger 20, comprising the sandpaper sheets 25, is attached by means of staples 152 to a thin L-shaped mounting plate 157. The plate 157 is provided with a pair of slots 160 allowing the plate to be inserted under the spring 65. The bolts 72 pass through the slots 160 whereby when the bolts are tightened down against the clamping plate 70 the plate 157 is fixed between the spring 65 and the rotatable disc 145'.

In the embodiment of FIG. 14, a sanding finger 20 is conveniently fastened to an elongated, flat, flexible biasing spring 165 (constructed of suitable material) by means of a plurality of staples 170 (see FIG. 15). A portion of the sanding finger and the biasing spring are configured to be insertable within a recess 175 of a rotatable disc 180. The recess 175 has a wedging surface 185 which cooperates with an adjustable wedge 190 having a generally trapezoidal cross-section (see FIG. 16). Once the sanding finger 20 and the biasing spring 165 are inserted within the recess 175, the wedge 190 may be forced against the sanding finger 20 by tightening down on a pair of screws 200. The screws 200 pass through a pair of slots 205 in the wedge 190 and threadingly engage the disc 180. Forcing the wedge against the sanding finger 20 causes the sanding finger and the biasing spring 165 to be forced against the wedging surface 105 whereby the sanding finger 20 and the biasing spring 165 are clamped or fixed between the wedge 190 and the wedging surface 185.

Figure 17:
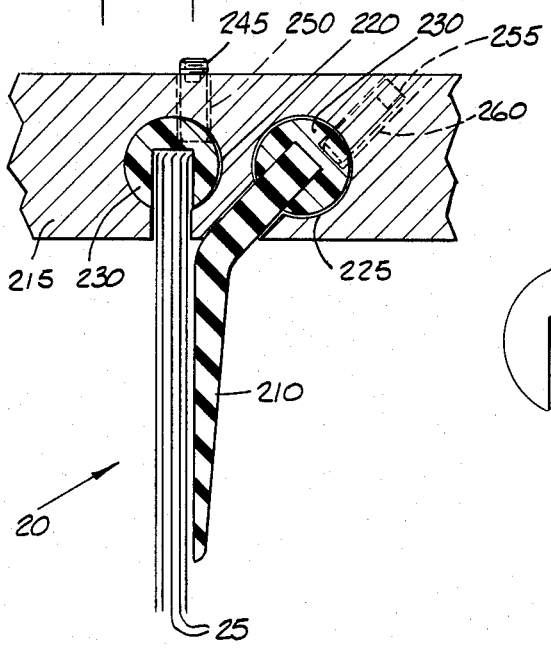
FIG. 17 is a cross-sectional view of a further embodiment for mounting an abrasive member and a flexible biasing spring.
Figure 18:
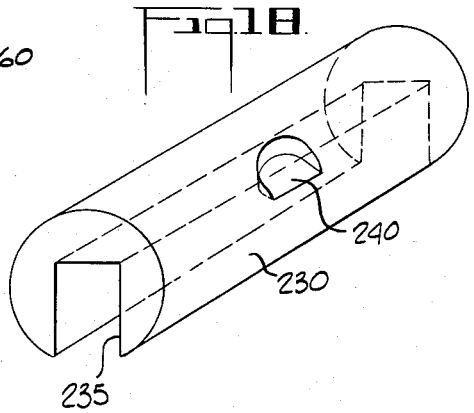
FIG. 18 is an enlarged perspective view of a portion of the mounting for the abrasive member and biasing spring of FIG. 17.

Referring now to FIG. 17, a sanding finger 20 and a flexible biasing spring 210 is shown as being carried or mounted on a rotatable disc 215. The sanding finger 20 and the biasing spring 210 are mounted in a keyway 220 and a keyway 225, respectively, by means of a tumbler clamp 230 configured to be insertable within the keyways 220, 225. As illustrated in FIG. 18, the clamp 230 comprises an elongated cylindrical body having a slot or an open-ended axial retainer channel 235 and a screw flat 240. The clamp 230 may be made of any suitable material such as, e.g., metal or plastic.

In use, the sanding finger 20 is inserted within the channel 235. The clamp 230 is then inserted within the keyway 220 whereafter a screw 245, threadably cooperating with a threaded hole 250 formed in the disc 215, may contact the screw flat 240. Turning in of the screw 245 imparts a torque on the clamp 230 whereby it is rotated and the sanding finger 20 is wedged or clamped within the keyway 220. In addition to enabling the clamp 230 to be rotated, the screw flat 240 acts as a constraint against axial movement of the clamp within the keyway 220.

The biasing spring 210, provided with a dog-leg stem allowing the spring to be positioned contiguous the sanding finger 20, may also be inserted into the channel 235 of a clamp 230. After the clamp 230 is inserted within the keyway 225, a screw 255, cooperating with a threaded hole 260, and the screw flat 240, can rotate the clamp 230 and lock the biasing spring 210 within the keyway 225.

What has been described are embodiments of an abrading device or a sander which allow the abrasive or sanding members to maintain a uniform contacting pressure on a work surface. The uniform pressure is substantially provided by the flexible biasing springs forcing the sanding members to keep in contact with the work surface to be sanded or finished. The biasing means of a sander of the present invention also allows all sanding members to simultaneously contact the work surface. A simultaneous contact generates a multi-directional finish on the work surface thereby minimizing the probability of creating undesirable striations. Minimization of striations reduces the amount of any subsequent hand work to be performed on the work surface. Since the sanding members are biased towards the work surface, the sanding members have increased surface contact with the work surface. Consequently, sanding time using the present invention is decreased compared to the sanders of the prior art assuming that substantially the same operating rotary speeds and pressures are applied during sanding. Finally, the control of the sanding pressure or the pressure applied against the work surface is facilitated during use of the present sander. This advantage is obtained by controlling the spring constant of the biasing springs through proper design and experimentation.

The above described embodiments are illustrative of the invention which may be modified within the scope of the appended claims.

What is claimed and desired to be secured by Letters Patent of the United States is:

1. An abrading tool for providing a surface with a smooth finish having substantially no striations, comprising:

a hub having a planar face capable of being presented to said surface, said hub being rotatable about an axis of rotation oriented perpendicular to said planar face, said hub being provided with a plurality of keyways extending radially outwardly from said axis of rotation and being disposed proximate the periphery of said hub, each of said keyways communicating with said planar face through a slot extending radially outwardly from said axis of rotation;

a plurality of flexible abrasive pads carried by said hub and extending from said planar face, each of said pads comprising a plurality of abrasive sheets of material and a key attached to said abrasive sheets, the key of each of said pads being inserted in a respective one of said keyways and extending through said slot whereby the abrasive sheets of each of said pads extend along a plane that is substantially perpendicular to said planar face and passes through said axis of rotation;

a releasable ring circumscribing said hub for constraining the key of each of said pads within said keyways, and L-shaped biasing means disposed only on one side of each of said pads for biasing the abrasive sheets of each of said pads towards a position that is substantially perpendicular to said planar face to enable the abrasive sheets of each of said pads to be urged, in use, towards said surface with a substantially equal force, said biasing means comprising a flexible elastomeric spring extending substantially coextensively with said abrasive sheets, said spring having a short base portion and an arm portion extending proximate said abrasive sheets, said base portion being substantially perpendicular to said arm portion and mounted to said planar face, whereby during use of said tool, the abrasive sheets of each of said pads may be simultaneously biased into contact with said surface to form a smooth finish having substantially no striations.

* * * * *